US005692966A

United States Patent [19]

Wash

[11] Patent Number: 5,692,966

[45] Date of Patent: Dec. 2, 1997

[54] GOLF PUTTING TRAINING DEVICE

[76] Inventor: Stephen G. Wash, 2693 W. 119th Ave., Westminster, Colo. 80234

[21] Appl. No.: 749,073

[22] Filed: Nov. 14, 1996

Related U.S. Application Data

[63] Continuation of Ser. No. 520,158, Aug. 28, 1995, abandoned, which is a continuation of Ser. No. 185,503, Jan. 24, 1994, abandoned, which is a continuation-in-part of Ser. No. 27,397, Mar. 8, 1993, abandoned.

[51] Int. Cl.[6] ..... A63B 69/36

[52] U.S. Cl. ..... 473/221; 473/224; 473/180; 473/409; 473/240

[58] Field of Search ..... 463/219–226, 463/231, 238, 240, 267–268, 409; 434/252; 364/410

[56] References Cited

U.S. PATENT DOCUMENTS

| | | | |
|---|---|---|---|
| 3,194,563 | 7/1965 | MacKniesh | 273/186.1 |
| 3,802,709 | 4/1974 | Elkins, Jr. | 273/186 |
| 3,953,034 | 4/1976 | Nelson | 273/186 |
| 4,251,077 | 2/1981 | Pelz et al. | 273/186 |
| 4,306,722 | 12/1981 | Rusnak | 473/221 |
| 4,341,384 | 7/1982 | Thackrey | 273/186 |
| 4,997,189 | 3/1991 | Perkins | 473/221 |
| 5,029,868 | 7/1991 | Cloud | 273/186 |
| 5,213,331 | 5/1993 | Avanzini | 473/220 |
| 5,257,084 | 10/1993 | Marsh | 473/223 |
| 5,324,039 | 6/1994 | Reimers et al. | 473/222 |
| 5,330,188 | 7/1994 | Reimers | 473/220 |
| 5,435,562 | 7/1995 | Stock et al. | 473/220 |
| 5,452,897 | 9/1995 | Mick | 473/251 |

FOREIGN PATENT DOCUMENTS

| | | | |
|---|---|---|---|
| 52-51227 | 4/1977 | Japan | 273/186.1 |

*Primary Examiner*—Jessica Harrison
*Assistant Examiner*—Mark A. Sager
*Attorney, Agent, or Firm*—Fields & Johnson, P.C.

[57] ABSTRACT

A golf putting training device has been provided which has a housing with a generally vertical planer front for sitting on a putting surface. A non-coherent light source is mounted in the housing for projecting a light from the front across the putting surface to the face of a golf putter head from a first location on the front of the housing. A receptor for receiving reflecting light from a specular reflecting surface mounted on a golf putter head is spaced laterally a predetermined distance from the desired golf ball impact point on the putter head. The receptor is vertically spaced from the first location. A target light is provided in the front of the housing which is laterally spaced from the first location a distance equal to the predetermined distance for aligning the putter head in proper orientation for putting a golf ball toward the target light. A signal means is also provided in the housing for providing a signal responsive to reflected light striking the receptor when the putter is properly aligned. Circuitry is provided to cancel out extraneous reflected light.

10 Claims, 5 Drawing Sheets

GOLF PUTTING TRAINING DEVICE

This application is a continuation of application Ser. No. 08/520,158, filed Aug. 28, 1995, now abandoned, which is a continuation of application Ser. No. 08/185,503, filed Jan. 24, 1994, abandoned, which is a continuation in part of application Ser. No. 08/027,397, filed Mar. 8, 1993, abandoned.

TECHNICAL FIELD

This invention relates to a golf putting training device and more particularly to one which provides substantially parallel alignment of the putter head face with the target regardless of the vertical orientation of the putter head face.

Putting in the game of golf consists of striking a golf ball with a specific putting club to achieve the goal of causing the ball to fall into a 4¼ inch diameter hole. Research by others indicates that on average, putts are 30 feet or less in length and that the strokes incurred while putting constitute 43% of the average golfer's total score for a golf round. Although the putting stroke consists of many variables that can contribute to success, essentially no effective modern technology has been offered to aid the golfer to improve his control of these variables.

Of the many variables involved in putting, one of the most essential is the initial putting club head alignment to the target. The putting club head has a face with a planar surface which is to be aligned perpendicularly to the line drawn between the center of the hole and the center of the golf ball. The golfer performs this task by alternately looking down at the putter face from a standing position and looking forward toward the intended target. The objective is to align the putter face perpendicularly with the target line within the angular accuracy governed by simple geometry that will ensure that when the ball is struck, it starts rolling along the target line. This task becomes increasingly difficult as the length of the putt increases. Specifically, the alignment of the putter necessary is 3.4 degrees at 3 feet, 2.0 degrees at 5 feet, 1.0 degree at the 10 feet, 0.5 degrees at 20 feet, 0.33 degrees at 30 feet, and so on. This difficulty is magnified by the fact that the golfer has no aid to tell him when he is correctly aligned. Research indicates that at 10 feet, only 3% of golfers have the putter aligned accurately enough to cause the ball to hit the hole; 97% are misaligned and this misalignment averages about 10 inches and ranges up to 3 feet misalignment at 10 feet.

Various training devices have been provided to assist golfers in improving their putting alignment and putting stokes. Among these are the following patents:

Perkins U.S. Pat. No. 4,997,189 shows a light transmitting and receiving device on one side of a simulated golf hole and a putter with a reflective surface is provided on the other side of the simulated hole. The light is directed toward the putter and is reflected off of a reflective surface on the face of the putter or attached to it in one of the positions illustrated. The reflected light is directed back to the surface of a target board. A putt is supposed to be aligned when the reflected light hits a vertical locus which will illuminate a visual display and can also provide an audible response. If the putter is misaligned, the light will strike one of a plurality of vertical slots on opposite sides the of locus which will energize signaling devices to indicate misalignment. Because of the offset of the light source from the locus, accurate alignment is difficult with this device.

Pelze et al. U.S. Pat. No. 4,251,077 shows a device for transmitting and receiving light to be reflected off of a mirror on the end of a golf club back to sensors which activate one or more of an array of lights. It is intended that the golfer will perfectly align the club to illuminate the light array before swinging the club. When swinging the club the mirrored surface will leave the beam of light on the backstroke and will reenter the beam of light as the club contacts the ball to illuminate the appropriate light showing the angle of the club face when it strikes the ball. A shortcoming of this device is that it would be very difficult to be sure that the light transmitting and receiving device is properly oriented with respect to the target to which the ball is to be hit.

Elkins Jr. U.S. Pat. No. 3,802,709 discloses a device for projecting light to a mirror on the handle of a golf club and back to a surface to indicate the alignment of the club. A camera is provided for taking a picture of the position of the light on the target surface as the club strikes the ball. This device would not compensate for different golfer's stances where the golf club handle is moved left or right or fore or aft.

Cloud U.S. Pat. No. 5,029,868 discloses a golf putting device in which light is provided from a source in the handle of the club and projected by optical fibers to one or two openings in the face of the club for projection onto a vertical surface so that alignment of the club with respect to that surface can be determined. Vertical bars are provided on this surface to serve as an indicia to determine the extent of misalignment.

DISCLOSURE OF THE INVENTION

In accordance with this invention, a golf putting training device has been provided which has a housing with a generally vertical, planer front for sitting on a putting surface. A non-coherent light source is mounted in the housing for projecting a light from a first location on the housing front across the putting surface to the face of a golf putter head. A dedicated target detector in the front of the housing spaced vertically from the first location is provided for receiving reflected light from a specular reflecting surface mounted on the golf putter head and spaced at a laterally predetermined distance from the desired golf ball impact point on the putter head. A target is provided in the front of the housing which is laterally spaced from the first location a distance equal to the predetermined distance for aligning the putter head in proper orientation for putting a golf ball toward the target. A signal means is also provided in the housing for providing a signal responsive to reflected light striking the dedicated target detector when the putter is properly aligned.

The signal means can be a signal light vertically aligned with the target in the front of the housing which is activated when the putter head is aligned. Additionally, an auditory device, such as a buzzer can be provided which is also activated when the putter head is properly aligned. Conveniently, the housing has a centerline and a width which is equal to the diameter of a golf hole. The target lies along the centerline of the housing so that the housing provides an aiming point and the target identifies the center of the aiming point. The device is symmetrical so that it can be turned over to accommodate either a right-handed or a left-handed golfer.

The reflecting surface can be a mirror which has a convex curvature along a vertical axis and a flat curvature along a horizontal axis. The convex curvature compensates for variations of vertical alignment of the putter head while the flat curvature provides a direct indication of horizontal alignment of the putter head with the front of the housing.

The light source generates an encoded infrared optical signal and receiving means decodes the optical signal to differentiate the optical signal from background radiation to trigger the signal means. The optical signal can be encoded in a variety of ways. By way of example, in the present invention it is contemplated that the infrared optical signal is encoded by conditioning the light in two ways. First, the light is transmitted for a period of 40 microseconds and then is shut off for a period of 7 to 10 milliseconds. This on and off cycling is continuously repeated resulting in a pulsing light source. Secondly, the infrared light source is emitted in a narrow wavelength band, typically, centered around 940 nanometers. The optical signal is decoded by photodiodes contained in the electronic circuitry of the device. Specifically, the photodiodes are optically filtered to generally restrict the passage of light other than light having the wavelength of the transmitted infrared light. Additionally, a comparator in the electronic circuitry is limited to respond only to signals occurring during each 40 microsecond period that the device is transmitting. Thus, the pulsing light and narrow emitted wavelength endow the infrared light source with a unique characteristic when compared to other light sources present in the environment.

Additionally, a dedicated reference detector is spaced laterally from the dedicated target detector. The circuitry connected to these detectors substantially cancels out any extraneous light reflected onto the detectors so that only light reflected by the mirror onto the dedicated target detector activates the signal means.

A method of improving golf putter alignment is also provided. It includes the steps of placing a light projecting device on a putting surface, which device has a width equal to the diameter of the golf hole, so that a non-coherent light beam is projected from the front of the device across a putting surface. A golf putter is positioned with its head on the putting surface with the face of the putter intercepting light beam. A mirror is positioned on the face of the putter head at a predetermined lateral distance from the desired golf ball striking point on the putter head face. A target is provided on the device laterally spaced from the light beam a distance equal to the predetermined lateral distance and a signal is produced indicative of alignment of the putter head face with the target. Once alignment has been achieved, the golfer can swing the putter through a normal putting swing so that when the putter head reaches the desired golf ball impact location, if the putter head face is still aligned with the target, it will produce a signal indicating proper alignment.

Additional advantages of this invention will become apparent from the description which follows, taken in conjunction with the accompanying drawings.

BEST MODE FOR CARRYING OUT THE INVENTION

Figure 1:
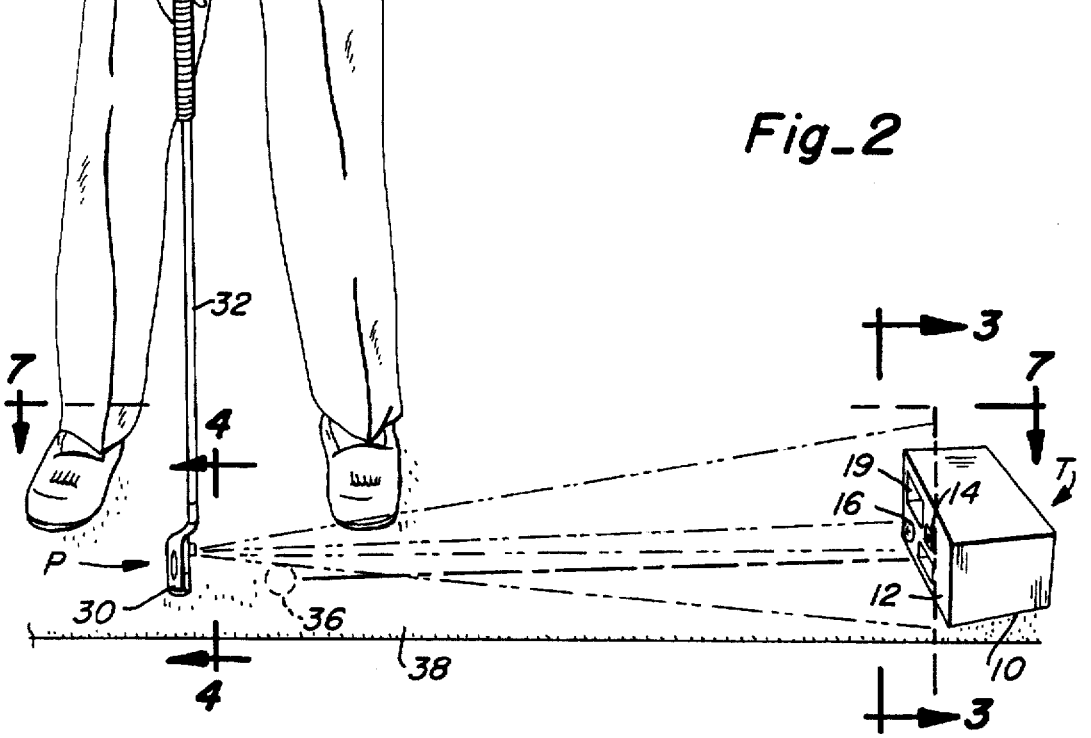
FIG. 1 is a side view of a golfer utilizing the golf putter alignment device of this invention.

In accordance with this invention, a golf putting training device T is provided which can be addressed by a golfer with a putter P as shown in FIG. 1. The distance has been foreshortened between the training device T and the golfer for convenience of illustration. However, the present invention is intended for use across distances in excess of twenty-five feet. Also training device T may be mounted on an open stand (not shown) above the putting surface a distance greater than the diameter of a golf ball so that the golf ball can be putted under the device in response to a normal putting swing.

Figure 2:
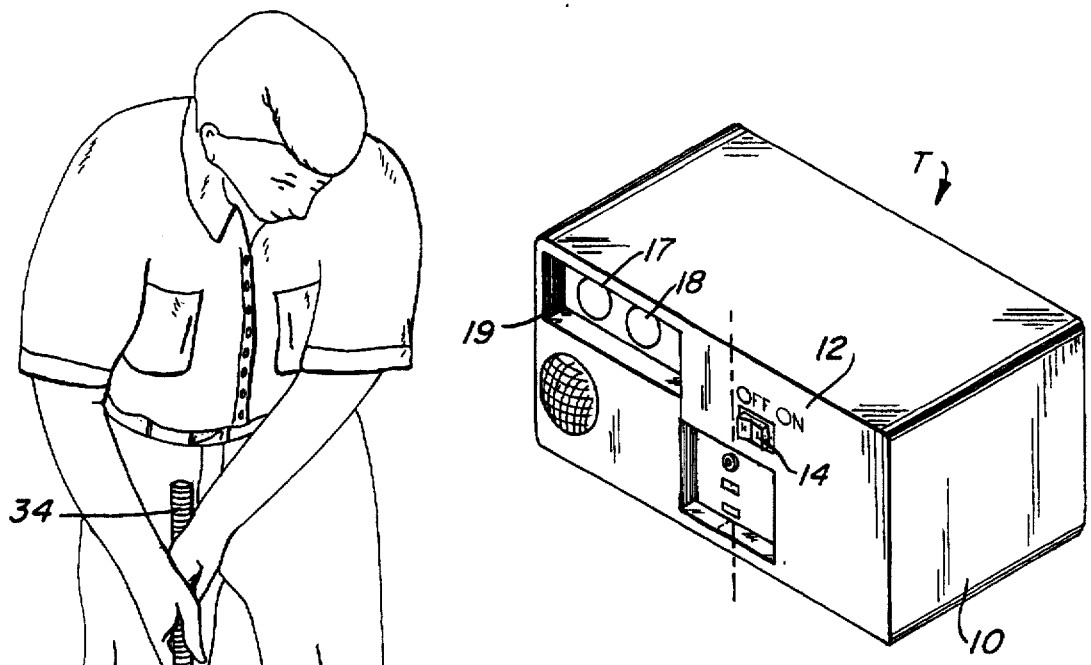
FIG. 2 is an enlarged perspective view of the golf putter alignment device.
Figure 13:
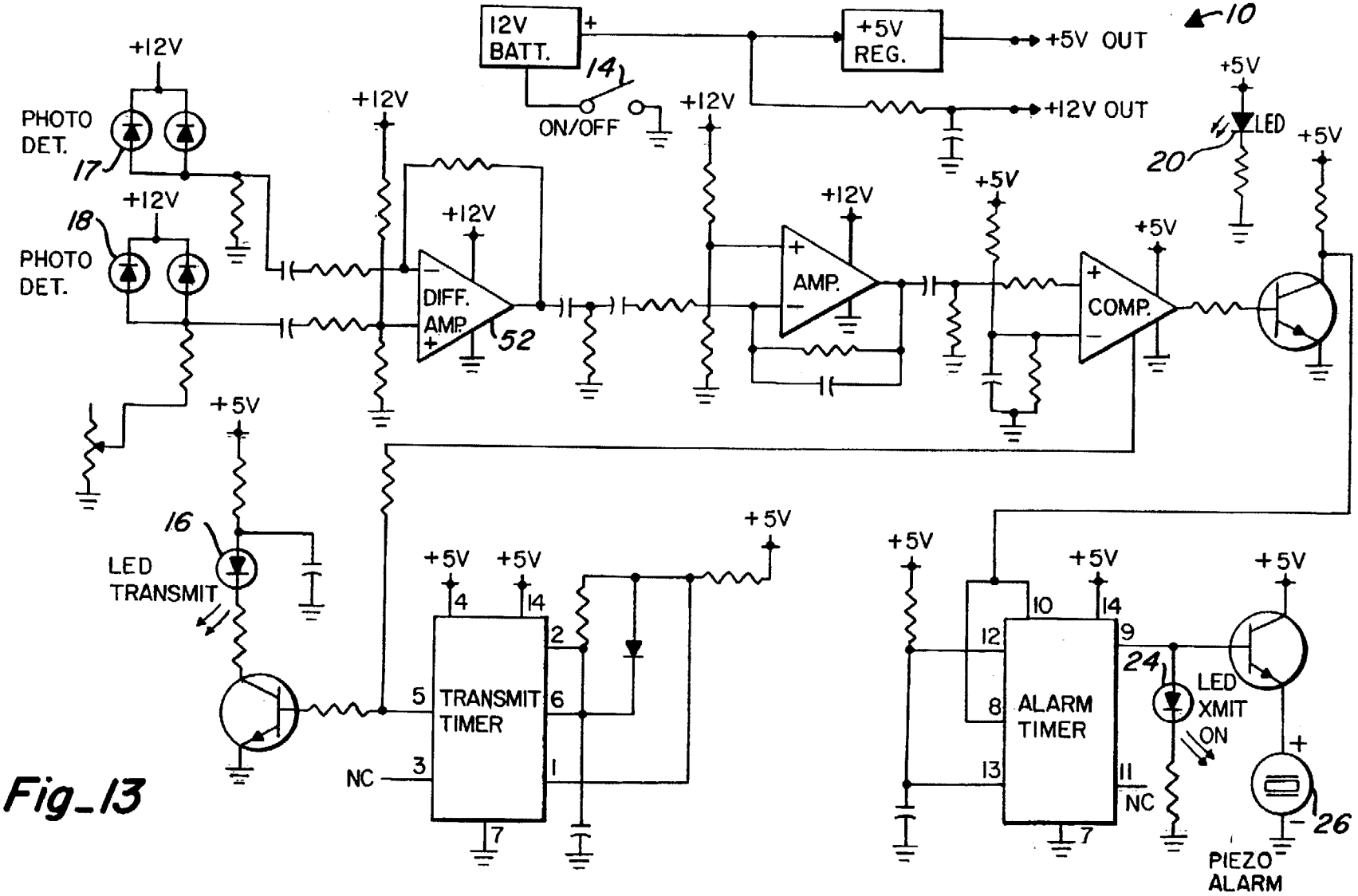
FIG. 13 is a circuit diagram for circuitry in the golf putter alignment device.

Training device T includes a housing 10 which holds all of the optical and audio circuitry, associated with this device, shown in FIG. 13. As best seen in FIG. 2, housing 10 has a generally rectangular shape, but could be any other desired shape. However, it is desirable for it to have a width of 4.25 inches, the same as the diameter of a golf hole. This allows the device to serve as a target area with which the golfer will align his putter P. The training device T is intended to be portable and is powered by a 12 volt battery supply, which may consist of eight size AA batteries. As will be more fully explained below, training device T generates an encoded infrared optical signal which is intercepted by a reflector on the putter head face and returned to a optical receiver in the training device. The receiver includes a dedicated target detector and a dedicated reference detector. Circuitry within training device T decodes the reflected optical signal to differentiate it from background radiation and triggers a visual and/or audio signal device to alert the golfer when the reflected light has been received, thereby indicating that the putter head is properly aligned. It is within the scope of this invention that a different portion of the light spectrum may be used, but the infrared portion is believed to be the most practical. The generated infrared optical signal is encoded to prevent the device from detecting and inadvertently responding to other sources of light present in the environment. Without encoding, the device cannot accurately respond to light generated by the device. The transmitted infrared optical signal is encoded by endowing the infrared light with two characteristics. First, the infrared optical signal generated by the device is encoded by pulsing the light on and off. The generated infrared optical signal is transmitted for a period of 40 microseconds followed by the generated optical signal beam turned off for 7 to 10 milliseconds. Secondly, the generated optical signal is emitted in a narrow wavelength, typically, centered around 940 nanometers. These two features "encode" the generated optical signal by endowing it with unique characteristics when compared to other light present in the environment. Other light sources within the environment may possess one of these characteristics, but are unlikely to possess both. In order to take advantage of the encoded signal, the encoded signal must be decoded. The encoded optical signal is decoded by photodiodes found within the circuitry of the training device. The photodiodes are optically filtered such that the photodiodes restrict the passage of light other than light having the wavelength of the transmitted optical signal. Additionally, a comparator in the electronic circuitry is limited to responding only to optical signals occurring during each 40 microsecond period that the device is transmitting an optical signal. Thus, the comparator is matched with the on and off cycling of the generated infrared signal such that the comparator effectively decodes the received optical signals. Although this disclosure provides a specific manner in which generated light may be "encoded" and "decoded", it will be understood that generated light may be conditioned in a number of other manners so to achieve the purpose of distinguishing the generated optical signal from environmental light.

Figure 3:
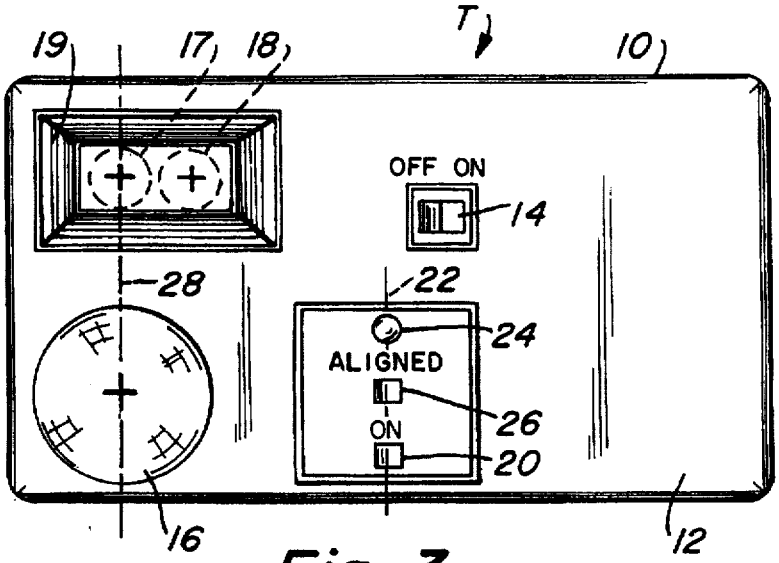
FIG. 3 is a front elevation of the golf putter alignment device.

As best seen in FIGS. 2 and 3, training device T has a vertical, planar front 12 which includes an on-off switch 14, a lens 16 through which a non-coherent infrared light beam is transmitted from a light source. A dedicated target detector 17 is positioned above lens 16 for receiving a reflected light beam. Spaced inwardly approximately one inch from dedicated target detector 17 is a dedicated reference detector 18. Conveniently these detectors are mounted in a recess 19 to block extraneous side light from striking the detectors.

The device also has a target 20 in the form of a LED which indicates when the device is turned on and also provides an aiming or target point for the golfer. Conveniently, target 20 is located equidistant between the side edges of front 12. Along a vertical axis 22, passing through target 20, lies a signal in the form of an target or target light signal 24 which becomes illuminated when the reflected light is intercepted by dedicated target detector 17. Optionally, the device may be provided with a audio alarm 26, such as a piezo alarm. The vertical axis along which target 20 and signal 24 lie, is spaced a predetermined distance from the vertical axis 28 lying along the center of lens 16 and the center of dedicated target detector 17. As best seen in FIGS. 1, and 4–6, the putter P has a head 30 attached to the lower end of a shaft 32 and has a handle 34 at the upper end thereof which is gripped by the golfer for addressing a golf ball 36. Golf ball 36 is shown in phantom in FIG. 1 since a golfer can practice the golf swing without the golf ball in place and can practice his putter head alignment with training device T without the presence of a golf ball. If he wishes, the golf ball can be placed on the putting surface 38 and stroked lightly but not so hard as to strike training device T and damage it or used with a stand (not shown) as previously described, so that a normal putting stroke can be used. Also, the device can be placed on one side of a golf hole on a putting surface and the golfer can stand on the other side and actually practice the golf swing while putting a golf ball into the hole.

Figure 4:
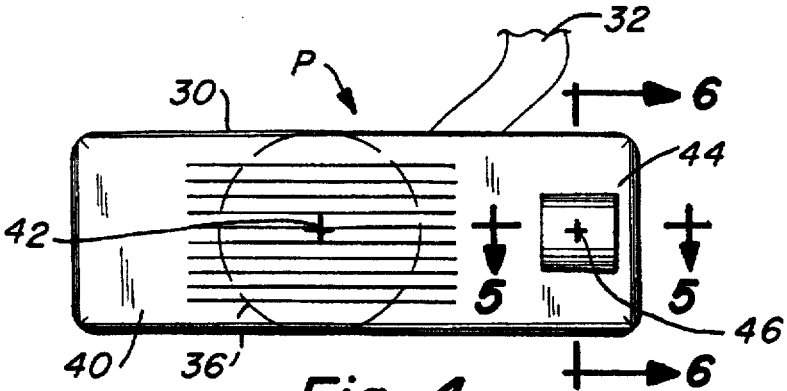
FIG. 4 is a front elevation of the face of a golf putter head.
Figure 10:
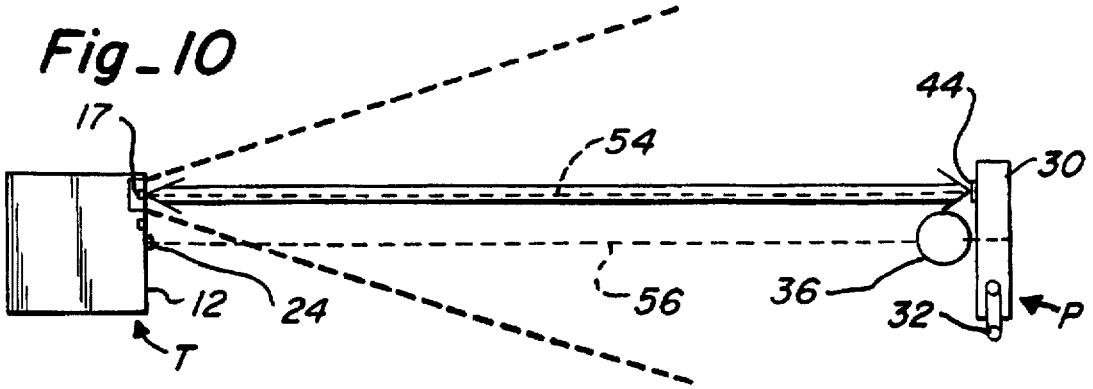
FIG. 10 is a diagrammatic top plan view showing the reflection of the projected light off of the mirror when the putter head is properly aligned in front of the golf putter alignment device.
Figure 11:
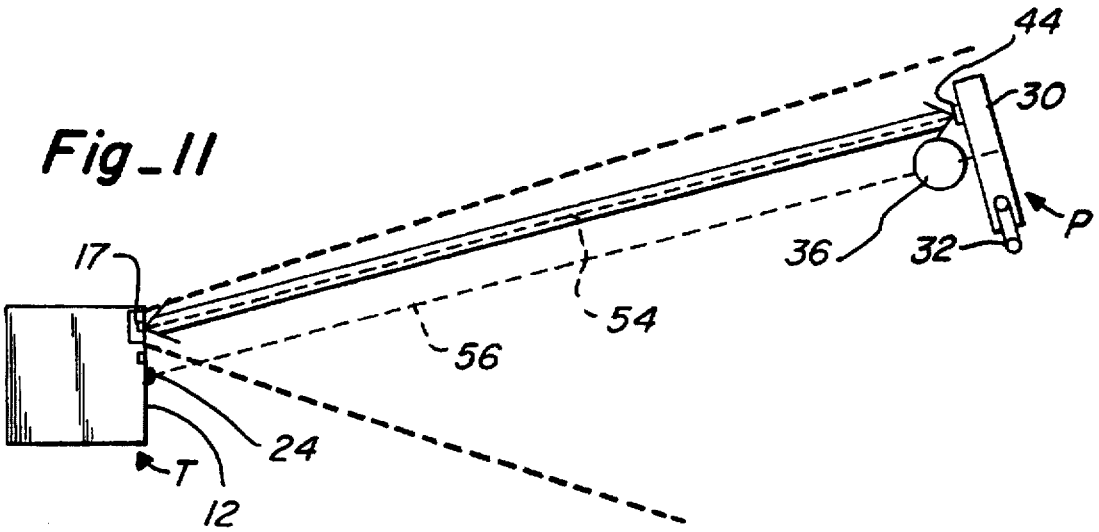
FIG. 11 is a diagrammatic top plan view showing the reflection of the projected light from the mirror on the putter head when the putter head is offset from the golf putter alignment device, but properly aligned.
Figure 12:
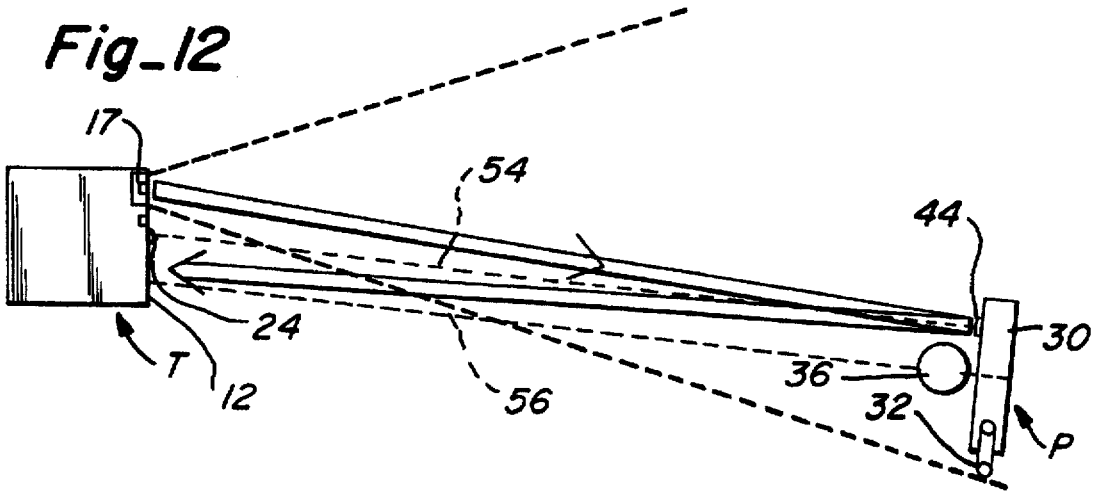
FIG. 12 is a diagrammatic top plan view, similar to FIG. 11, but showing the putter head in misaligned position.

In order for the golfer to hit the golf ball into the hole, it is important that the face 40 of putter head be properly aligned with the golf hole. The purpose of training device T is to give a visual and/or audio indication as to when the face 40 of putter head 30 is correctly aligned. The putter has a preferred golf ball impact point 42, as seen in FIG. 4, which is located near the center of putting surface 40. Conveniently, a reflecting device, such as mirror 44 is spaced laterally from impact point 42 a distance such that the center 46 of the mirror is the same distance from impact point 42 as center 28 of lens 16 is from vertical axis 22. The mirror can be attached to the heel of the putter head, as shown in FIGS. 1 and 4–6, or to the toe of the putter head, as shown in FIGS. 10–12. The training device will be turned over for use with the respective positions of the mirror to provide the correct geometric relationship. This geometric relationship is highly significant in the function of the invention, as explained more fully below.

Figure 5:
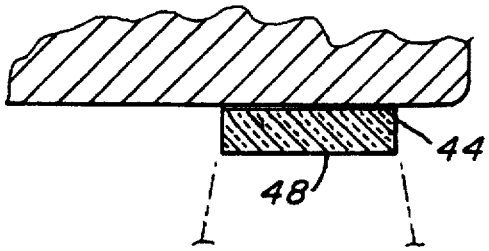
FIG. 5 is an enlarged horizontal section, taken along line 5—5 of FIG. 4, showing the flat curvature of the mirror in the lateral direction.
Figure 6:
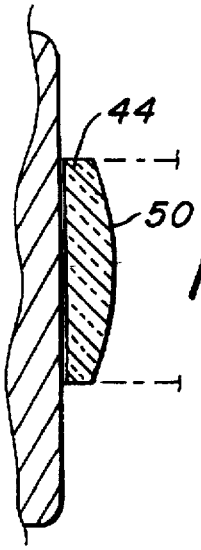
FIG. 6 is an enlarged vertical section, taken along line 6—6 of FIG. 4, showing the convex curvature of the mirror along the vertical axis.

Mirror 44, conveniently, has a flat curvature 48, i.e., no curvature, in the lateral direction, as seen in FIG. 5, and a convex curvature 50 as shown in FIG. 6. With the mirror being constructed as just described, the shaft 32 of the putter can be tilted back and forth to any position which is comfortable to the golfer. This in turn will pivot the face 40 of putter head 30 with respect to a vertical plane. However, because of the convex curvature of 50 of mirror 46, the reflected beam will be a wide beam which will intercept target detector 17 regardless of any normal variation in the vertical angle of face 40. However, lateral alignment will be quite precise because of the flat curvature 48 of mirror 44 which causes a generally parallel beam to be reflected from mirror 44, as seen in FIGS. 10–12.

The relationship between dedicated target detector 17 and dedicated reference detector 18 will now be discussed. When a beam of infrared light is transmitted, it encounters many reflective surfaces that may return a portion of the beam to the dedicated target detector 17. Such surfaces include the ground surface, structures and walls, golf balls that lie in front of the device, etc. The reflectivity of these surfaces and their distance from the device determine the intensity of the infrared light reflected (background reflection) to dedicated target detector 17.

The intensity of the light returned to dedicated target detector 17 by the putter mirror at ten or twenty feet may be very small when compared to the total background reflection under many circumstances. For example, if the putter mirror at twenty feet reflected the beam to dedicated target detector 17 and generated a 200 mV signal when correctly aligned, an alignment alarm circuit to produce an alarm for any signal greater than 180 mV might be provided. This would ensure that the device would set off the alarm with correct alignment at twenty feet or less. However, background reflection alone can produce a signal much greater than 180 mV under many circumstances, such as when the device is pointed at a white wall or when several golf balls have been putted "short" and are in front of training device T. If the alarm circuit were set to respond to any signal greater than 180 mV, it would set off an alarm under these conditions even though the putter was not correctly aligned. A circuit, as shown in FIG. 13, must be provided which rejects background reflections but accepts putter mirror reflections. The circuit therefore is designed with an "auto-zero" feature that accomplishes this objective.

The detection scheme takes advantage of the fact that background reflection is typically diffuse while the specular putter mirror reflection is highly directional.

The detector circuitry consists of a dedicated target detector 17 mounted on the vertical axis of the beam transmitted through lens 16 and a dedicated reference detector mounted inboard approximately one inch. The basic strategy is for the device to provide an alarm indicating correct putter alignment only when the reflection from the putter mirror 44 impinges directly on dedicated target detector 17.

Since background reflection is diffuse in nature, both the target and reference detectors 17 and 18 see identical reflected intensity and generate identical signals. The signals from the target and reference detectors 17 and 18 are compared by differential amplifier 52 of FIG. 13.

Figure 8:
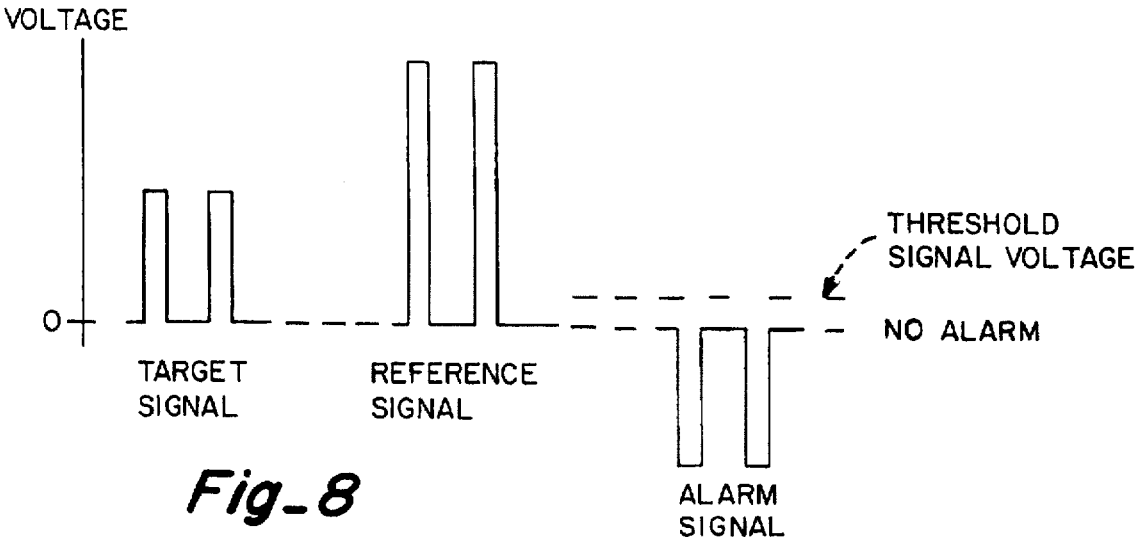
FIG. 8 is a graph showing a negative alarm signal when the reflected light from the mirror strikes the reference detector.

When the target and reference signals are equal, regardless of their absolute value, the output of amplifier 52 is therefore zero. It therefore does not matter how much background reflection is present at any time because the resulting output will be zero for equal signals at both detectors. If the alarm circuit is preset to respond to a positive 150 mV signal no alignment alarm will occur. An alarm condition will be met only when the specular reflection from the putter mirror 44 is impinging on dedicated target detector 17. Under any other condition the signal to the alarm circuit would be zero or negative if the reflected putter mirror beam impinges on dedicated reference detector 18, as in FIG. 8.

Figure 7:
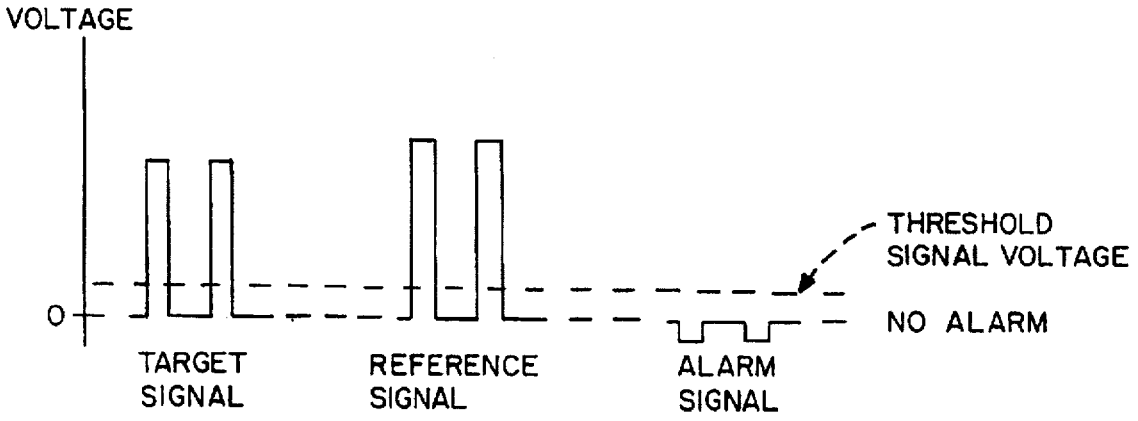
FIG. 7 is a graph showing a negative alarm signal caused by extraneous reflected light.
Figure 9:
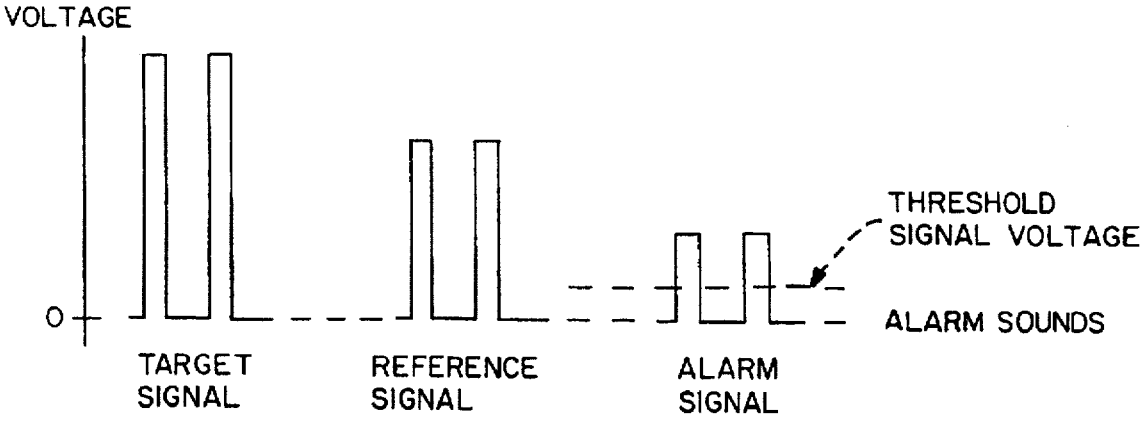
FIG. 9 is a graph showing a positive alarm signal when the reflected light from the mirror strikes the dedicated target detector.

To avoid false alarm triggering, dedicated reference detector 18 is intentionally biased to generate a larger signal than dedicated target detector 17 when both detectors are receiving identical background reflection, as illustrated in FIG. 7. To cause an alignment alarm, the signal at dedicated target detector 17 must be sufficiently greater than that at dedicated reference detector 18 to both overcome the overbias of reference detector 18 and to overcome the 150 mV threshold voltage of the alarm circuit. The net result is that the device will indicate alignment only when the putter mirror 44 is correctly aligned to produce signals as illustrated in FIG. 9.

As previously described, the golfer attaches mirror 44 to the planar putter face 40 offset from the spot on the face where the golf ball centerline would be during putting a distance equal to the distance between the device centerline 22 and the target detector/beam source centerline 28. Since the mirror 44 has a planar back parallel to the planar face in the axis of interest, the face of the mirror in the axis of interest is parallel to the putter face. Infrared light reflected from the mirror surface, which is planar along a horizontal axis 54, behaves according to classical physics where the angle of incidence of the transmitted beam relative to a line normal to the mirror surface equals the angle of reflection from the mirror surface relative to the line normal to the mirror surface. This causes the face aiming line 56 of putter head 30 to be aimed at the center, i.e., at the target 20. The device function takes advantage of this parallel nature as depicted in FIGS. 10 and 11. Both the transmitted beam source and the target detector of the device lie in the same vertical axis. A transmitted beam will be reflected along the horizontal axis 54 of the mirror 44 back to the dedicated target detector 17 only when the angle of incidence and angle of reflection equals zero to produce a correct alignment alarm. This is true even if the putter face is not parallel to the device face, as shown in FIG. 11.

Conversely, when the face aiming line 56 does not pass through the device centerline and intercept target 20, a line normal to the mirror surface will not pass through the dedicated target detector 17 and will not generate an alarm, as illustrated in FIG. 12.

The device has been designed to respond with a correct alignment alarm when the face aiming line 56 is within plus or minus one mirror width of the device centerline. That is with a one half inch wide mirror the face aiming line 56 must be positioned by the operator within one half inch of the device centerline to generate a correct alignment alarm. This will provide an accuracy at three feet of 0.80°, at five feet of 0.48°, at ten feet of 024° and at twenty feet of 0.12°. If the mirror selected is one quarter inch wide the operator must align the putter face within one quarter of an inch. This will provide an accuracy at three feet of 0.40°, at five feet of 0.24°, at ten feet of 0.12° and at twenty feet of 0.06°. With mirror sizes of similar dimension the deviation due to reflected beam spreading and the putter position within the beam becomes incidental as they induce only very small fractional error as compared to the device design accuracy.

From the foregoing, the advantages of this invention are readily apparent. A golf putting training device has been provided which by the use of a mirror offset from the impact point on a putter head equidistant to the offset of distance between a lens transmitting a non-coherent light and a target light, the golfer can be assured that vertical misalignment of the golf club will not matter but lateral alignment of the putter head will be precisely indicated. When the putter head is properly aligned, light will be reflected back to the receiver in the training device which will activate a visual and/or audio signal. This will inform the golfer when the putter head is properly positioned for striking the golf ball. When the golfer swings the putter through a normal putting swing, he will be able to tell when the putter strikes the ball whether or not the putter head face is still properly aligned. Since the training device has the same width as a golf hole, it can be used without the need of a golf hole and can be used with or without a golf ball as the golfer desires. The symmetry of the device allows it to be flipped over for use with either a right-handed or left-handed golfer.

This invention has been described in detail with reference to particular embodiments thereof, but it will be understood that various other modifications can be effected within the spirit and scope of this invention.

I claim:

1. A golf putting training device comprising:

a golf putter having a putter face, said putter face having a distal end, a proximal end, and a golf ball impact point positioned between said distal end and said proximal end;

a housing;

a specular surface mounted on the putter face and selectively spaced a lateral predetermined distance away from the golf ball impact point;

a non-coherent light source having a vertical axis for projecting a light beam from said housing across a putting surface to said specular surface;

a dedicated target detector spaced above said non-coherent light source along said vertical axis thereof for receiving reflected light from said specular surface and for receiving extraneous reflected light, said target detector producing a first output signal responsive to the sum of the reflected light from said specular surface and the received extraneous reflected light;

a dedicated reference detector spaced from said target detector for receiving the extraneous reflected light, said reference detector producing a second output signal responsive to the received extraneous reflected light;

circuitry for comparing said first output signal and said second output signal and providing a differential signal;

a target mounted in said housing and laterally spaced from said target detector a first distance equal to said lateral predetermined distance for aligning said putter face in proper orientation for putting a golf ball toward said target;

a signal means responsive to said differential signal indicating when the putter face is properly aligned with said target; and said housing is positioned for orienting said specular surface such that said specular surface is located on the putter face at said lateral predetermined distance away from the golf ball impact point on either the distal end or proximal end of said putter face.

2. The golf putting training device, as claimed in claim 1, wherein said signal means comprises:

a signal light aligned with said target in said housing.

3. The golf putting training device, as claimed in claim 1, wherein said signal means comprises:

an auditory device creating an auditory signal when the putter face is properly aligned with said target.

4. The golf putting training device, as claimed in claim 1, wherein said specular surface comprises:

a mirror having a convex curvature shape with respect to a vertical orientation and a flat shape with respect to a horizontal orientation, said convex curvature shape compensating for variations in vertical alignment of said putter face with respect to said target.

5. The golf putting training device, as claimed in claim 1, wherein:

said non-coherent light source generates an encoded infrared optical signal; and said target detector and said reference detector decode said optical signal to differentiate said optical signal from the extraneous reflected light.

6. A method of improving a golf putter alignment comprising the steps of:

placing a light projecting and receiving device on a putting surface, the light projecting and receiving device having a centerline, a light source for projecting a light beam from the light projecting and receiving device across the putting surface, and a receiver spaced from the centerline a predetermined lateral distance;

positioning a golf putter having a putter face near the putting surface at a remote location from the light projecting and receiving device, the golf putter having a desired golf ball striking point on the putter face;

positioning a mirror on the putter face and spaced from the desired golf ball striking point said predetermined lateral distance, the mirror provided for reflecting the projected light beam back to the receiver when the putter face is correctly aligned;

providing a target on the light projecting and receiving device as an alignment point;

moving the golf putter through a normal putting swing so that the golf putter impacts a golf ball placed in alignment with the desired golf ball striking point;

receiving the reflected light beam by a dedicated target detector in the receiver;

receiving extraneous reflected light by the dedicated target detector and by a dedicated reference detector in the receiver; and producing a signal, responsive to the reflected light beam and the continuously received extraneous reflected light striking the dedicated target detector and dedicated reference detector, which is indicative of proper alignment of the putter face with the target as the putter impacts the golf ball.

7. A method, as claimed in claim 6, including the further step of:

encoding the light source by endowing the light source with a pulsing characteristic and limiting the light source to a specified wavelength band; and decoding the encoded light to produce the signal.

8. A method of improving a golfer's putting alignment with a golf hole, said method comprising the steps of:

placing a light projecting and receiving device on a putting surface;

placing a putter on a putter surface, the putter having a putter face including a proximal end and a distal end;

determining a golf ball impact point which is positioned between the proximal end and the distal end of the putter face;

placing a golf ball adjacent the putter face in alignment with the golf ball impact point;

placing a reflective surface on the putter face at either the proximal or distal end of the putter face, the reflective surface being spaced a predetermined lateral distance from the golf ball impact point;

determining a target point on the light projecting and receiving device;

projecting a beam of light from a light source on the light projecting and receiving device to the reflective surface on the face of the putter head;

reflecting the light beam from the reflective surface back to the light reflecting and receiving device;

receiving the reflected light beam when the golfer's putter alignment is correct and receiving background light from the environment by means of a dedicated target detector spaced from the target point said predetermined lateral distance;

receiving the reflected light beam when the golfer's putter alignment is misaligned, and receiving background light from the environment by means of a dedicated reference detector;

comparing a target signal produced by the target detector due to the received reflected light beam and the received background light with that of a reference signal produced by the reference detector due to the received reflected light beam and the received background light; and producing an alarm signal responsive to the comparison of the target signal and reference signal which is indicative of alignment of the putter face with the target point.

9. A method, as claimed in claim 8, including the further steps of:

encoding the light source by endowing the projected light beam with a pulsing characteristic and limiting the projected light beam to a specified wavelength; and decoding the encoded light source by matching the target detector and reference detector to the frequency of the encoded light source and filtering out received background light not having the specified wavelength.

10. A method, as claimed in claim 8, including the further step, once alignment has been achieved, of:

moving the putter through a normal putting swing so that when the putter impacts the golf ball, the putter face is aligned with the target point to produce the alarm signal indicating alignment.

* * * * *

UNITED STATES PATENT AND TRADEMARK OFFICE

CERTIFICATE OF CORRECTION

PATENT NO. : 5,692,966

DATED : December 2, 1997

INVENTOR(S) : Stephen G. Wash

It is certified that error appears in the above-identified patent and that said Letters Patent is hereby corrected as shown below:

Column 5, lines 41-42, delete "signal in the form of an target or target light";
Column 9, line 63, delete "continuously".

Signed and Sealed this

Twelfth Day of May, 1998

Bruce Lehman

*Attest:*

BRUCE LEHMAN

*Attesting Officer*

*Commissioner of Patents and Trademarks*